US006984612B2

(12) United States Patent
Maillie

(10) Patent No.: US 6,984,612 B2
(45) Date of Patent: Jan. 10, 2006

(54) HEADLIGHT CLEANER, RESTORER, AND METHODS FOR THE MANUFACTURE AND USE THEREOF

(76) Inventor: David Francis Maillie, 3003 Emerald Meadow La., Charlotte, NC (US) 28273

( * ) Notice: Subject to any disclaimer, the term of this patent is extended or adjusted under 35 U.S.C. 154(b) by 153 days.

(21) Appl. No.: 10/771,934

(22) Filed: Feb. 5, 2004

(65) Prior Publication Data

US 2005/0159325 A1 Jul. 21, 2005

Related U.S. Application Data

(60) Provisional application No. 60/516,418, filed on Nov. 3, 2003.

(51) Int. Cl.
*C11D 3/16* (2006.01)
*C11D 3/43* (2006.01)
*B08B 3/04* (2006.01)

(52) U.S. Cl. ..... 510/163; 510/179; 510/181; 510/199; 510/243; 134/38; 134/39; 134/40; 134/42

(58) Field of Classification Search ..... 510/163, 510/179, 181, 199, 243; 134/38, 39, 40, 134/42

See application file for complete search history.

(56) References Cited

U.S. PATENT DOCUMENTS 6,831,049 B1 * 12/2004 Torres Moreno ..... 510/243
2005/0159325 A1 * 7/2005 Maillie ..... 510/243

* cited by examiner

*Primary Examiner*—Brian P. Mruk

(57) ABSTRACT

An automotive headlight restorer and cleaner which removes oxidation and yellow haziness and restores optical clarity. The method of manufacture consists of several solutions. Solution A, which is an industrial degreasing compound, diluted to 1:20. Solution B1 is a mixture of 53%–56% mineral spirits, 1%–3% butanol, and gloss spar varnish and/or acrylic urethane. Solution B1 is used on lenses with heavy oxidation and severe damage. It will improve them greatly, but not restore them to like new clarity. Solutions B2 and C are for lenses with less severe oxidation and damage (the majority of lenses fit in this category.) Solution B2 is a fine cut cleaner (a professional quality rubbing compound of low abrasive content with diminishing abrasiveness). Solution C is a combination wax, polish, sealer. This solution protects against future damage to the lenses. Subsequent methods for the manufacture and use of this method for headlight restoration and cleaning for the purpose of removing yellowing and haziness are provided.

3 Claims, No Drawings

HEADLIGHT CLEANER, RESTORER, AND METHODS FOR THE MANUFACTURE AND USE THEREOF

This application claims the benefit of Provisional Application No. 60/164,418, filed Nov. 3, 2003.

FIELD OF THE INVENTION

The invention relates to headlight cleaning and restoration and to methods of application and manufacture of such. The full purpose of this invention is to remove haziness, yellowing, and restore visibility to headlight lenses.

BACKGROUND OF THE INVENTION

A few types of headlight cleaners or restorers are available. Most of which use harsh cleaners, cheap waxes and metal polish meant for other applications, and/or clear lacquer paint. The harsh cleaners, usually solvent based, can actually worsen or weaken the lens. Some have recommended the use of high speed buffers or rough sandpaper (around 400 grit) to remove tougher haziness. This can be very detrimental to the fragile plastic of the lens. Also this process is short lived and usually only lasts 1–2 months before it must be repeated. Sometimes the yellow haziness returns in less than 2 weeks. Some use clear lacquer paint to seal the lens. This paint is not meant for plastic and actually eats the plastic leaving a rough finish. It does not last long either as it has no protection against UV radiation and severe weather.

There are no known patents for headlight cleaners or restorers that remove yellowing or haziness.

SUMMARY OF THE INVENTION

Headlight cleaning and restoration, methods of application, and methods of manufacture is provided according to the invention. The method of manufacture consists of several solutions. Solution A, which is an industrial degreasing compound, diluted to 1:20. Solution B1 is a mixture of 53%–56% mineral spirits, 1%–3% butanol, and gloss spar varnish and/or acrylic urethane. Solution B1 is used on lenses with heavy oxidation and severe damage. It will improve them greatly, but not restore them to like new clarity. Solutions B2 and C are for lenses with less severe oxidation and damage (the majority of lenses fit in this category.) Solution B2 is a fine cut cleaner (a professional quality rubbing compound of low abrasive content with diminishing abrasiveness. Solution C is a combination wax, polish, sealer. This solution protects against future damage to the lenses. Subsequent methods for the manufacture and use of this method for headlight restoration and cleaning for the purpose of removing yellowing and haziness are provided.

DETAILED DESCRIPTION OF THE INVENTION

Automotive manufacturers have, in recent years, switched to a clear plastic headlight lens that tends to yellow or haze after only a few years use—or less in some cases. Headlights can be restored to almost new or new in many of these cases by the application of the following methods of application and manufacture.

The method, consists of several solutions The first (solution A) which is a solution of industrial grade degreaser diluted to 1:20 with water. At this concentration it is still very effective for removing grease, tar, dirt, etc . . . from the headlight lens. It also renders it harmless to paint, plastic, flesh, etc. . . . Stronger concentrations could possibly etch or mar the plastic.

The second solution B1, is a mixture of 53%–56% mineral spirits, 1%–3% butanol, and gloss spar varnish and/or acrylic urethane. This mixture is ideal as it stays in solution and no mixing is necessary. This solution dries in about 2 hours and a typical application will be about 6–7 mil thick. This gives it excellent build or fill characteristics which help fill in heavy scratches and build an effective and protective layer on the lens. Gloss spar varnish or clear gloss water based polyurethane is favored because they are made for outdoor use and harsh elements—the gloss spar has built in UV inhibitors so this treatment will last many years. This B1 solution is for treatment of more severely damaged headlights as it will improve their condition greatly and has great build properties, but will not restore optical clarity.

The rest of the solutions are for cloudy or hazy lights with lower levels of damage from oxidation and weathering (the most prevalent condition). These solutions (B2 and C), when used correctly, can be quite effective. They do not have the build properties of the previous B1 solution, but it can produce a lens that looks 100% new and restore optical clarity (the previous composition will produce up to 95% newer).

Solution B2 is a basic automotive rubbing compound fine cut cleaner (low grade rubbing compound). This solution basically used to remove deep oxidation, embedded debris, grease, etc . . . from the lens. Usually the lens will start to appear quite clear after just one application of solution B2. A professional polisher can be used to speed up this process.

If it is still cloudy, fine grit sandpaper (800–1000 grit should only be used) can be used to wet sand imperfections from the lens. Then use the solution B2 to minimize these scratches.

Solution C can be either in liquid or paste form (this is a low or no cut formula). It is a high end polish, very light scratch remover that leaves a hard UV inhibitive shell. This will further smooth out the surface and restore optical clarity. Solution C is a liquid polymer sealant/wax containing silicone and PTFE or PCTFE in an aqueous solution. This liquid sealer or wax will seal the entire surface of the lens and protects it from UV radiation and harsh elements. With out solution C the lens would return to its previous condition in under a month.

This method is packaged together as follows for single retail purchases:

(1) One 2 oz bottle of solution A
(2) One 1 oz bottle of solution B
(3) One 1 oz. bottle of solution C
(4) One vinyl or blue nitrile glove (to keep hands clean)
(5) Two pieces of 800–2000 grit wet or dry sandpaper
(6) One foam applicator pad
(7) Two lint free shop towels These contents along with the plastic tub they are enclosed/packaged in constitute everything necessary by this method to fully clean or restore any plastic or glass headlight lens.

The method involves first using soap and water to clean off any noticeable dirt and debris from the lens. Then you take the contents of solution A and pour it in the tub. Fill the now empty container to solution A with water and add it to the tub. Thoroughly clean both headlights. Then take the lint free towel and wet it with fresh clean water (not solution A from the tub) and use this to fully wipe off both headlight lenses. Make sure that both lenses are fully dry before using solution B1 or B2. Try applying B2 first to determine the severity of the oxidation on your lenses.

Put on the enclosed glove and empty a small amount of the solution B2 on a section of clean towel and apply to the lights. Do the entire headlight, rubbing until the towel starts to come away clean and the lights get real smooth. Do one small section at a time. This solution B2 can be reapplied as many times as necessary. Remember, some headlights are more oxidized than others and may take more applications and more effort to achieve desired results.

If after several applications there is no noticeable improvement then you have a high level of damage and need to proceed to solution B1.

For solution B1 empty some of the solution on the foam grey applicator enclosed in the kit (using the grey foam side only) and apply to the lights. Do the entire headlight, covering each light with a light (not heavy) coat. Let it dry completely. More coats can be added once dry if necessary. You are now done.

If solution B2 brought about a noticeable improvement, then continue to use solution B2 until the towel comes away clean—no oxidation left. For quicker results or higher. Faster volume a power buffer with a wool pad can be used to quicken the process (especially in professional applications). Empty a small amount of solution C onto a clean section of towel. Rub this all over the headlight, again one small area at a time, until crystal clear.

This solution can be reapplied as many times as necessary. You are now done. The method described here is very effective in restoring clear plastic, and even glass, automotive headlights to like new or new condition. These methods were determined through much trial and error and the determination of David Maillie to create a viable solution to the problem of clouded, yellowed, hazy headlight lenses.

What is claimed is:

1. A headlight lens cleaning and restoring kit comprising:

A) a first solution comprising a degreaser diluted with water in a ratio of 1:20;

B) a second solution comprising 53–56% mineral spirits, 1–3% butanol, and at least one component selected from the group consisting of gloss spar varnish and acrylic urethane; and C) a third aqueous solution comprising a polymer sealant/wax containing silicone and at least one component selected from the group consisting of polytetrafluoroethylene (PTFE) and polychlorotrifluoroethylene (PCTFE).

2. A headlight lens cleaning and restoring kit comprising:

A) a first solution comprising a degreaser diluted with water in a ratio of 1:20;

B) a second solution comprising 53–56% mineral spirits, 1–3% butanol, and at least one component selected from the group consisting of gloss spar varnish and acrylic urethane;

C) a third aqueous solution comprising a polymer sealant/wax containing silicone and at least one component selected from the group consisting of polytetrafluoroethylene (PTFE) and polychlorotrifluoroethylene (PCTFE);

D) one vinyl or blue nitrile glove;

E) two pieces of 800–2000 grit wet or dry sandpaper;

F) one foam applicator pad; and

G) two lint free shop towels.

3. A method for cleaning and restoring an automotive headlight lens comprising the following steps:

A) applying a first solution comprising a degreaser diluted with water in a ratio of 1:20 to the headlight lens;

B) applying water to the headlight lens and allowing the headlight lens to dry;

C) applying a second solution comprising 53–56% mineral spirits, 1–3% butanol, and at least one component selected from the group consisting of gloss spar varnish and acrylic urethane to the headlight lens and allowing the headlight lens to dry; and D) applying a third aqueous solution comprising a polymer sealant/wax containing silicone and at least one component selected from the group consisting of polytetrafluoroethylene (PTFE) and polychlorotrifluoroethylene (PCTFE) to the headlight lens and allowing the headlight lens to dry.

* * * * *